US009273561B2

(12) United States Patent
Lacy et al.

(10) Patent No.: US 9,273,561 B2
(45) Date of Patent: Mar. 1, 2016

(54) COOLING STRUCTURES FOR TURBINE ROTOR BLADE TIPS

(75) Inventors: Benjamin Paul Lacy, Greer, SC (US); Randall Richard Good, Simpsonville, SC (US); Brian Gene Brzek, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 836 days.

(21) Appl. No.: 13/566,202

(22) Filed: Aug. 3, 2012

(65) Prior Publication Data

US 2014/0037458 A1 Feb. 6, 2014

(51) Int. Cl.
*F01D 5/18* (2006.01)
*F01D 5/20* (2006.01)

(52) U.S. Cl.
CPC *F01D 5/20* (2013.01); *F01D 5/186* (2013.01); *F05D 2250/182* (2013.01)

(58) Field of Classification Search
CPC ..... F01D 5/14; F01D 5/147; F01D 5/146; F01D 5/18; F01D 5/186; F01D 5/20; F01D 11/08; F01D 11/12; F01D 25/12; F05D 2260/202; F05D 2260/70; F05D 2260/221; F05D 2260/2214; F05D 2240/307; F05D 2240/55; F05D 2240/607; Y02T 50/676
USPC ..... 415/115; 416/97 R
See application file for complete search history.

(56) References Cited

U.S. PATENT DOCUMENTS 4,761,116 A * 8/1988 Braddy et al. ..... 416/92
5,192,192 A * 3/1993 Ourhaan ..... 416/97 R
5,261,789 A 11/1993 Butts et al.
5,458,461 A 10/1995 Lee et al.
5,503,527 A * 4/1996 Lee et al. ..... 416/91
5,927,946 A * 7/1999 Lee ..... 416/97 R
6,050,777 A 4/2000 Tabbita et al.
6,059,530 A 5/2000 Lee
6,179,556 B1 * 1/2001 Bunker ..... 415/115
6,190,129 B1 2/2001 Mayer et al.
6,210,112 B1 4/2001 Tabbita et al.
6,231,307 B1 * 5/2001 Correia ..... 416/97 R
6,234,755 B1 5/2001 Bunker et al.

(Continued)

FOREIGN PATENT DOCUMENTS

JP 55114806 A 9/1980
JP H09195704 A 7/1997

OTHER PUBLICATIONS

Search Report and Written Opinion from PCT/US2013/053134 dated Sep. 13, 2013.

*Primary Examiner* — Dwayne J White
*Assistant Examiner* — Joshua R Beebe
(74) *Attorney, Agent, or Firm* — Mark E. Henderson; Ernest G. Cusick; Frank A. Landgraff

(57) ABSTRACT

A rotor blade for a turbine of a combustion turbine engine having an airfoil that includes a pressure and a suction sidewall defining an outer periphery and a tip portion defining an outer radial end. The tip portion includes a rail that defines a tip cavity. The airfoil includes an interior cooling passage configured to circulate coolant. The rotor blade further includes: a slotted portion of the rail; and at least one film cooling outlet disposed within at least one of the pressure sidewall and the suction sidewall of the airfoil. The film cooling outlet includes a position that is adjacent to the tip portion and in proximity to the slotted portion of the rail.

18 Claims, 10 Drawing Sheets

(56) References Cited

U.S. PATENT DOCUMENTS

| | | | | |
|---|---|---|---|---|
| 6,382,913 | B1 * | 5/2002 | Lee et al. | 416/96 R |
| 6,494,678 | B1 * | 12/2002 | Bunker | 416/97 R |
| 6,971,851 | B2 * | 12/2005 | Liang | 416/1 |
| 6,991,430 | B2 * | 1/2006 | Stec et al. | 416/97 R |
| 7,600,977 | B2 * | 10/2009 | Shadbolt et al. | 416/224 |
| 7,704,045 | B1 * | 4/2010 | Liang | 416/92 |
| 7,857,587 | B2 * | 12/2010 | Correia et al. | 416/92 |
| 8,061,987 | B1 * | 11/2011 | Liang | 416/92 |
| 8,066,485 | B1 * | 11/2011 | Liang | 416/97 R |
| 8,113,779 | B1 * | 2/2012 | Liang | 416/92 |
| 8,313,287 | B2 * | 11/2012 | Little | 415/173.1 |
| 8,469,666 | B1 * | 6/2013 | Liang | 416/97 R |
| 2006/0088420 | A1 * | 4/2006 | Lee | 416/235 |
| 2010/0040478 | A1 | 2/2010 | Abdel-Messeh et al. | |
| 2010/0135813 | A1 * | 6/2010 | Marini et al. | 416/223 R |
| 2011/0091327 | A1 * | 4/2011 | Willett, Jr. | 416/235 |
| 2011/0097188 | A1 | 4/2011 | Bunker | |
| 2012/0070307 | A1 * | 3/2012 | Poon et al. | 416/97 R |

* cited by examiner

COOLING STRUCTURES FOR TURBINE ROTOR BLADE TIPS

BACKGROUND OF THE INVENTION

The present application relates generally to apparatus and systems for cooling the tips of gas turbine rotor blades. More specifically, but not by way of limitation, the present application relates to the configuration of rotor blade tip rails that enhance cooling performance.

In a gas turbine engine, it is well known that air is pressurized in a compressor and used to combust a fuel in a combustor to generate a flow of hot combustion gases, whereupon such gases flow downstream through one or more turbines so that energy can be extracted therefrom. In accordance with such a turbine, generally, rows of circumferentially spaced rotor blades extend radially outwardly from a supporting rotor disk. Each blade typically includes a dovetail that permits assembly and disassembly of the blade in a corresponding dovetail slot in the rotor disk, as well as an airfoil that extends radially outwardly from the dovetail.

The airfoil has a generally concave pressure side and generally convex suction side extending axially between corresponding leading and trailing edges and radially between a root and a tip. It will be understood that the blade tip is spaced closely to a radially outer turbine shroud for minimizing leakage therebetween of the combustion gases flowing downstream between the turbine blades. Maximum efficiency of the engine is obtained by minimizing the tip clearance or gap such that leakage is prevented, but this strategy is limited somewhat by the different thermal and mechanical expansion and contraction rates between the rotor blades and the turbine shroud and the motivation to avoid an undesirable scenario of having excessive tip rub against the shroud during operation.

Because turbine blades are bathed in hot combustion gases, effective cooling is required for ensuring a useful part life. Typically, the blade airfoils are hollow and disposed in flow communication with the compressor so that a portion of pressurized air bled therefrom is received for use in cooling the airfoils. Airfoil cooling in certain areas of the rotor blade is quite sophisticated and may be employed using various forms of internal cooling channels and features, as well as cooling outlets through the outer walls of the airfoil for discharging the cooling air. Nevertheless, airfoil tips are particularly difficult to cool since they are located directly adjacent to the turbine shroud and are heated by the hot combustion gases that flow through the tip gap. Accordingly, a portion of the air channeled inside the airfoil of the blade is typically discharged through the tip for the cooling thereof.

It will be appreciated that conventional blade tip design includes several different geometries and configurations that are meant to prevent leakage and increase cooling effectiveness. Exemplary patents include: U.S. Pat. No. 5,261,789 to Butts et al.; U.S. Pat. No. 6,179,556 to Bunker; U.S. Pat. No. 6,190,129 to Mayer et al.; and, U.S. Pat. No. 6,059,530 to Lee. However, conventional blade tip cooling designs, particularly those having a "squealer tip" design, have certain shortcomings, including the inefficient usage of compressor bypass air, which reduces plant efficiency. As a result, an improved turbine blade tip design that increases the overall effectiveness of the coolant directed to this region would be highly desired.

BRIEF DESCRIPTION OF THE INVENTION

The present application thus describes a rotor blade for a turbine of a combustion turbine engine. The rotor blade may have an airfoil that includes a pressure sidewall and a suction sidewall defining an outer periphery and a tip portion defining an outer radial end. The tip portion may include a rail that defines a tip cavity. The airfoil may include an interior cooling passage configured to circulate coolant through the airfoil during operation. The rotor blade may further include: a slotted portion of the rail; and at least one film cooling outlet disposed within at least one of the pressure sidewall and the suction sidewall of the airfoil. The film cooling outlet may include a position that is adjacent to the tip portion and in proximity to the slotted portion of the rail.

The present application further describes a rotor blade for a turbine of a combustion turbine engine. The rotor blade may include an airfoil that has a pressure sidewall and a suction sidewall defining an outer periphery and a tip portion defining an outer radial end. The tip portion may have a rail that defines a tip cavity, wherein the airfoil includes an interior cooling passage configured to circulate coolant through the airfoil during operation. The rotor blade may include: a slotted portion of the rail, the slotted portion of the rail including a plurality of slots spaced thereon; a plurality of film cooling outlets that are disposed within the pressure sidewall and/or the suction sidewall of the airfoil, each of the plurality of film cooling outlets may have a position that is adjacent to the tip portion and in proximity to the slotted portion of the rail; and a plurality of grooves formed between the slotted portion of the rail and the plurality of film cooling outlets. The plurality of slots and the plurality of film cooling outlets and the plurality of grooves may be configured such that each of the plurality of grooves extends in an approximate radially outward direction from a position at or just outboard of one of the plurality of film cooling outlets to a position at or just inboard of an inboard edge of one of the plurality of slots.

These and other features of the present application will become apparent upon review of the following detailed description of the preferred embodiments when taken in conjunction with the drawings and the appended claims.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
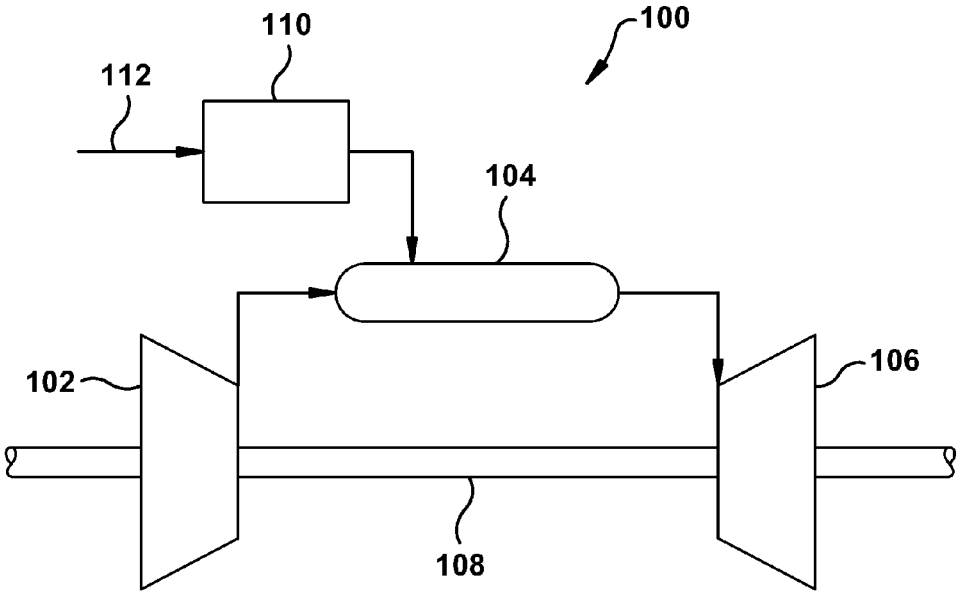
Figure 1 (Prior Art)
FIG. 1 is a schematic diagram of a combustion turbine engine.

FIG. 1 is a schematic diagram of an embodiment of a turbomachine system, such as a gas turbine system 100. The system 100 includes a compressor 102, a combustor 104, a turbine 106, a shaft 108 and a fuel nozzle 110. In an embodiment, the system 100 may include a plurality of compressors 102, combustors 104, turbines 106, shafts 108 and fuel nozzles 110. The compressor 102 and turbine 106 are coupled by the shaft 108. The shaft 108 may be a single shaft or a plurality of shaft segments coupled together to form shaft 108.

In an aspect, the combustor 104 uses liquid and/or gas fuel, such as natural gas or a hydrogen rich synthetic gas, to run the engine. For example, fuel nozzles 110 are in fluid communication with an air supply and a fuel supply 112. The fuel nozzles 110 create an air-fuel mixture, and discharge the air-fuel mixture into the combustor 104, thereby causing a combustion that creates a hot pressurized exhaust gas. The combustor 100 directs the hot pressurized gas through a transition piece into a turbine nozzle (or "stage one nozzle"), and other stages of buckets and nozzles causing turbine 106 rotation. The rotation of turbine 106 causes the shaft 108 to rotate, thereby compressing the air as it flows into the compressor 102. In an embodiment, hot gas path components, including, but not limited to, shrouds, diaphragms, nozzles, buckets and transition pieces are located in the turbine 106, where hot gas flow across the components causes creep, oxidation, wear and thermal fatigue of turbine parts. Controlling the temperature of the hot gas path components can reduce distress modes in the components. The efficiency of the gas turbine increases with an increase in firing temperature in the turbine system 100. As the firing temperature increases, the hot gas path components need to be properly cooled to meet service life. Components with improved arrangements for cooling of regions proximate to the hot gas path and methods for making such components are discussed in detail below with reference to FIGS. 2 through 12. Although the following discussion primarily focuses on gas turbines, the concepts discussed are not limited to gas turbines.

Before proceeding further, note that to communicate clearly the invention of the current application, it may be necessary to select terminology that refers to and describes certain machine components or parts of a turbine engine. Whenever possible, terminology that is used in the industry will be selected and employed in a manner consistent with its accepted meaning. However, it is meant that this terminology be given a broad meaning and not narrowly construed such that the meaning intended herein and the scope of the appended claims is restricted. Those of ordinary skill in the art will appreciate that often certain components are referred to with several different names. In addition, what may be described herein as a single part may include and be referenced in another context as several component parts, or, what may be described herein as including multiple component parts may be fashioned into and, in some cases, referred to as a single part. As such, in understanding the scope of the invention described herein, attention should not only be paid to the terminology and description provided, but also to the structure, configuration, function, and/or usage of the component.

In addition, several descriptive terms may be used herein. The meaning for these terms shall include the following definitions. The term "rotor blade", without further specificity, is a reference to the rotating blades of either the compressor 118 or the turbine 124, which include both compressor rotor blades 120 and turbine rotor blades 126. The term "stator blade", without further specificity, is a reference to the stationary blades of either the compressor 118 or the turbine 124, which include both compressor stator blades 122 and turbine stator blades 128. The term "blades" will be used herein to refer to either type of blade. Thus, without further specificity, the term "blades" is inclusive to all type of turbine engine blades, including compressor rotor blades 120, compressor stator blades 122, turbine rotor blades 126, and turbine stator blades 128. Further, as used herein, "downstream" and "upstream" are terms that indicate a direction relative to the flow of working fluid through the turbine. As such, the term "downstream" means the direction of the flow, and the term "upstream" means in the opposite direction of the flow through the turbine. Related to these terms, the terms "aft" and/or "trailing edge" refer to the downstream direction, the downstream end and/or in the direction of the downstream end of the component being described. And, the terms "forward" or "leading edge" refer to the upstream direction, the upstream end and/or in the direction of the upstream end of the component being described. The term "radial" refers to movement or position perpendicular to an axis. It is often required to describe parts that are at differing radial positions with regard to an axis. In this case, if a first component resides closer to the axis than a second component, it may be stated herein that the first component is "inboard" or "radially inward" of the second component. If, on the other hand, the first component resides further from the axis than the second component, it may be stated herein that the first component is "outboard" or "radially outward" of the second component. The term "axial" refers to movement or position parallel to an axis. And, the term "circumferential" refers to movement or position around an axis.

Figure 2:
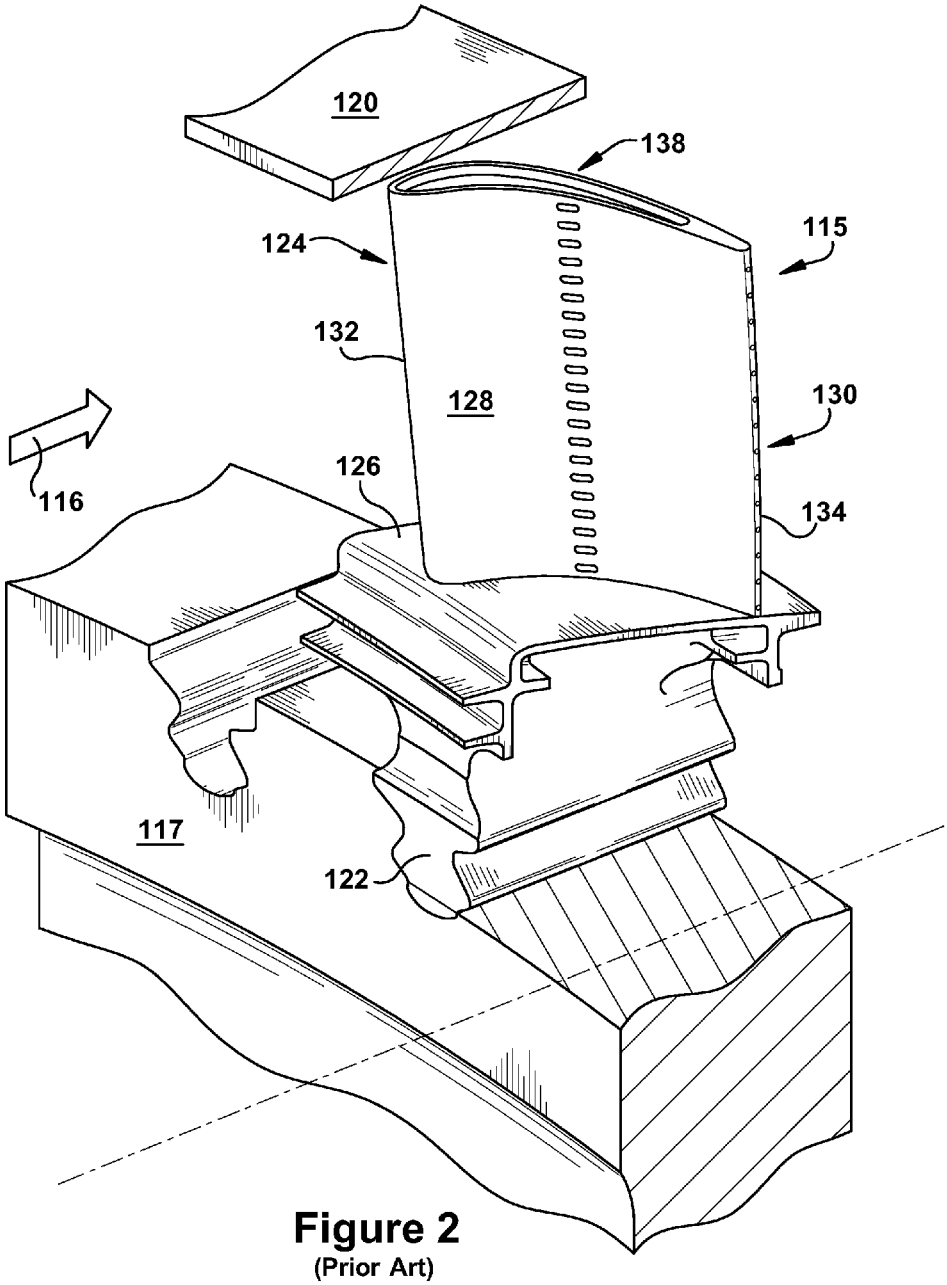
Figure 2 (Prior Art)
FIG. 2 is a perspective view of an exemplary rotor blade assembly including a rotor, a turbine blade, and a stationary shroud.

FIG. 2 is a perspective view of an exemplary hot gas path component, a turbine rotor blade 115 which is positioned in a turbine of a gas turbine or combustion engine. It will be appreciated that the turbine is mounted directly downstream from a combustor for receiving hot combustion gases 116 therefrom. The turbine, which is axisymmetrical about an axial centerline axis, includes a rotor disk 117 and a plurality of circumferentially spaced apart turbine rotor blades (only one of which is shown) extending radially outwardly from the rotor disk 117 along a radial axis. An annular turbine shroud 140 is suitably joined to a stationary stator casing (not shown) and surrounds the rotor blades 115 such that a relatively small clearance or gap remains therebetween that limits leakage of combustion gases during operation.

Each rotor blade 115 generally includes a root or dovetail 122 which may have any conventional form, such as an axial dovetail configured for being mounted in a corresponding dovetail slot in the perimeter of the rotor disk 117. A hollow airfoil 124 is integrally joined to dovetail 122 and extends radially or longitudinally outwardly therefrom. The rotor blade 115 also includes an integral platform 126 disposed at the junction of the airfoil 124 and the dovetail 122 for defining a portion of the radially inner flow path for combustion gases 116. It will be appreciated that the rotor blade 115 may be formed in any conventional manner, and is typically a one-piece casting. It will be seen that the airfoil 124 preferably includes a generally concave pressure sidewall 128 and a circumferentially or laterally opposite, generally convex suction sidewall 130 extending axially between opposite leading and trailing edges 132 and 134, respectively. The sidewalls 128 and 130 also extend in the radial direction from the platform 126 to a radially outer tip portion or blade tip 138.

In general, the blade tip 138 includes a tip cap 148 disposed atop the radially outer edges of the pressure 128 and suction sidewalls 130. The tip cap 148 typically bounds interior cooling passages (which, as discussed more below, is referenced herein as an "interior cooling passage 156") that are defined between the pressure 128 and suction sidewalls 130 of the airfoil 124. Coolant, such as compressed air bled from the compressor, may be circulated through the interior cooling passage during operation. The tip cap 148 typically includes a plurality of film cooling outlets 149 that release coolant during operation and promote film cooling over the surface of the blade tip 138. The tip cap 148 may be integral to the rotor blade 115 or, as shown, a portion may be welded/brazed into place after the blade is cast.

Due to certain performance advantages, such as reduced leakage flow, blade tips 138 frequently include a surrounding tip rail or rail 150. This type of blade tip is commonly referred to as a "squealer tip" or, alternatively, as a blade tip having a "squealer pocket" or "squealer cavity." Coinciding with the pressure sidewall 128 and suction sidewall 130, the rail 150 may be described as including a pressure side rail 152 and a suction side rail 153, respectively. Generally, the pressure side rail 152 extends radially outwardly from the tip cap 148 (i.e., forming an angle of approximately 90°, or close thereto, with the tip cap 148) and extends from the leading edge 132 (which in the case of the rail, may be referred to as a "leading rail edge") to the trailing edge 134 (which in the case of the rail, may be referred to as a "trailing rail edge") of the airfoil 124. As illustrated, the path of pressure side rail 152 is adjacent to or near the outer radial edge of the pressure sidewall 128 (i.e., at or near the periphery of the tip cap 148 such that it aligns with the outer radial edge of the pressure sidewall 128). Similarly, as illustrated, the suction side rail 153 projects radially outwardly from the tip cap 148 (i.e., forming an angle of approximately 90° with the tip cap 148) and extends from the leading rail edge to the trailing rail edge of the rail. The path of suction side rail 153 is adjacent to or near the outer radial edge of the suction sidewall 130 (i.e., at or near the periphery of the tip cap 148 such that it aligns with the outer radial edge of the suction sidewall 130). Both the pressure side rail 152 and the suction side rail 153 may be described as having an inner rail surface 157, which inwardly defines the tip cavity 155, and an outer rail surface 159, which is on the opposite side of the rail 150 and, thus, faces outwardly and away from the tip cavity 155. At the outer radial end, the rail 150 may be described as having an outboard rail surface 161 that faces in an outboard direction.

Those of ordinary skill in the art will appreciate that squealer tips in which the present invention is employed might vary somewhat from the characteristics described above. For example, the rail 150 may not necessarily follow precisely the profile of the outer radial edge of the pressure and/or suction sidewalls 128, 130. That is, in alternative types of tips in which the present invention may be used, the tip rails 150 may be moved away from the outer periphery of the tip cap 148. In addition, the tip rails 150 may not surround the tip cavity completely and, in certain cases, include large gaps formed therein, particularly in the portion of the rail positioned toward the trailing rail edge 134 of the blade tip 138. In some cases, the rail 150 might be removed from either the pressure side or the suction side of the tip 138. Alternatively, one or more rails may be positioned between the pressure side rail 152 and suction side rail 153.

The tip rail 150, as shown, generally, is configured to circumscribe the tip cap 148 such that a tip pocket or cavity 155 is defined in the tip portion 138. The height and width of the pressure side rail 152 and/or the suction side rail 153 (and thus the depth of the cavity 155) may be varied depending on best performance and the size of the overall turbine assembly. It will be appreciated that the tip cap 148 forms the floor of the cavity 155 (i.e., the inner radial boundary of the cavity), the tip rail 150 forms the side walls of the cavity 155, and that the tip cavity 155 remains open through an outer radial face, which, once installed within a turbine engine, is bordered closely by a stationary shroud 140 (as shown in FIG. 2) that is slightly radially offset therefrom.

Figure 3:
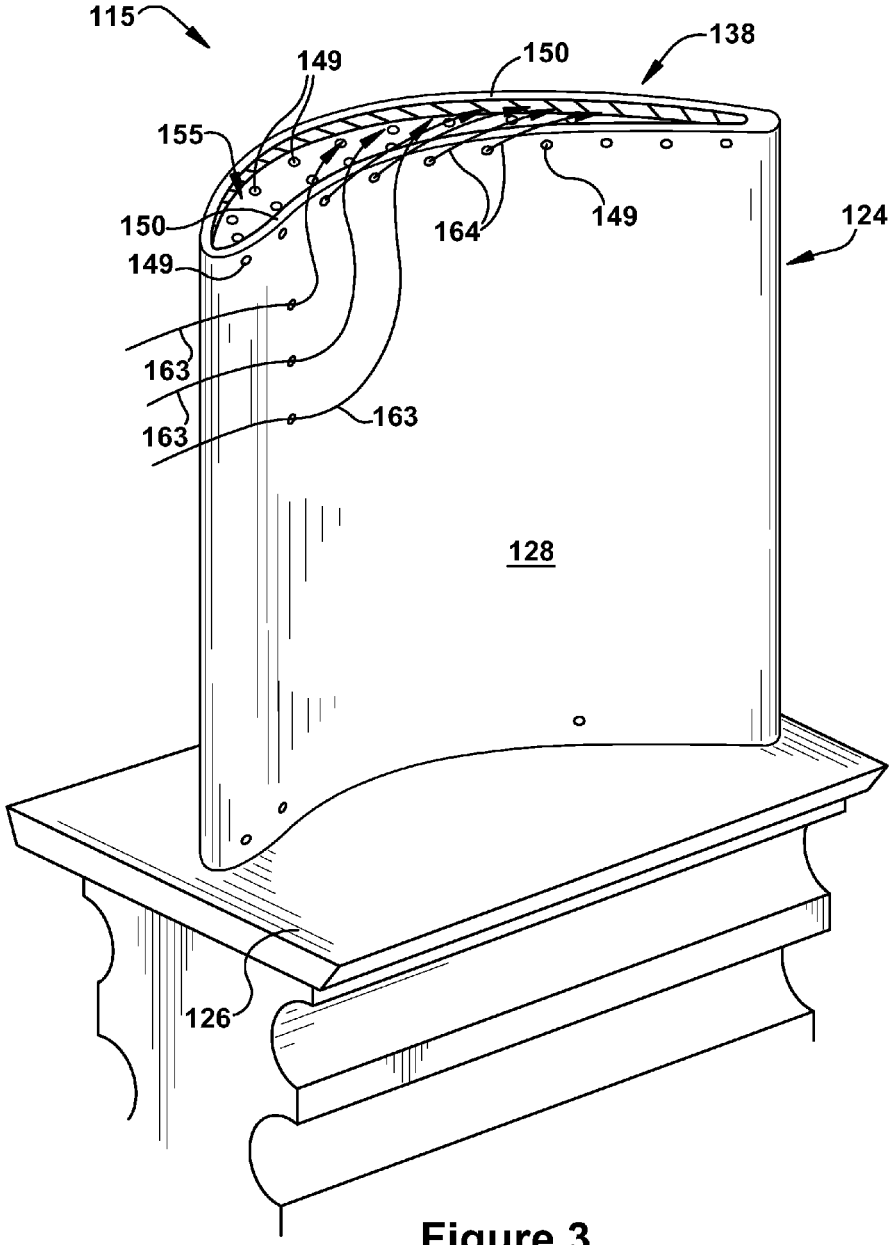
Figure 3 (Prior Art)
FIG. 3 is a perspective view of a turbine rotor blade having a squealer tip with cooling outlets along the airfoil and through the tip cap of the blade.

As shown in FIG. 3, a plurality of film cooling outlets 149 may be disposed on the blade tip 138 and the surface of the airfoil 124. Typically, film cooling outlets 149 are provided through the pressure sidewall 128 of the airfoil 124 as well as through the tip cap 148. Some designs use as many film outlets 149 as possible in the limited space available in an effort to flood the pressures side tip region with coolant. In regard to the outlets disposed on the pressure side wall 128, it is desired that, after the coolant released, the coolant then carries over onto rails 150 of the squealer tip and into tip cavity 155 to provide cooling therein and, then, over the suction side surfaces of tip 138 to provide cooling to this region. Toward this objective, film outlets 149 are oriented in the radially outward direction. Also, the film cooling outlets 149 may be angled with respect to the surface of airfoil 124. This angled introduction of coolant may limit mixing to a degree. Nevertheless, in practice, it is still very difficult to cool the blade tip 138 due to the complex nature of the cooling flow as it mixes with dynamic hot gases of the mainstream flow.

Hot air flows (generally illustrated as arrows 163) over airfoil 124 and exerts motive forces upon the outer surfaces of airfoil 124, in turn driving the turbine and generating power. The cooling flow (generally illustrated by arrows 164) exits film outlets 149 and is swept by hot air flow 163 towards a trailing edge 134 of airfoil 124 and away from tip cavity 155. Typically, this results in a mixed effect, where some of the cooling air is caught up and mixed with the hot gases and some goes into the tip cavity 155 and some goes axially along the airfoil to trailing edge 134. This requires the usage of excessive cooling air to cool this region, which, as stated, results in reduced plant efficiency.

Figure 4:
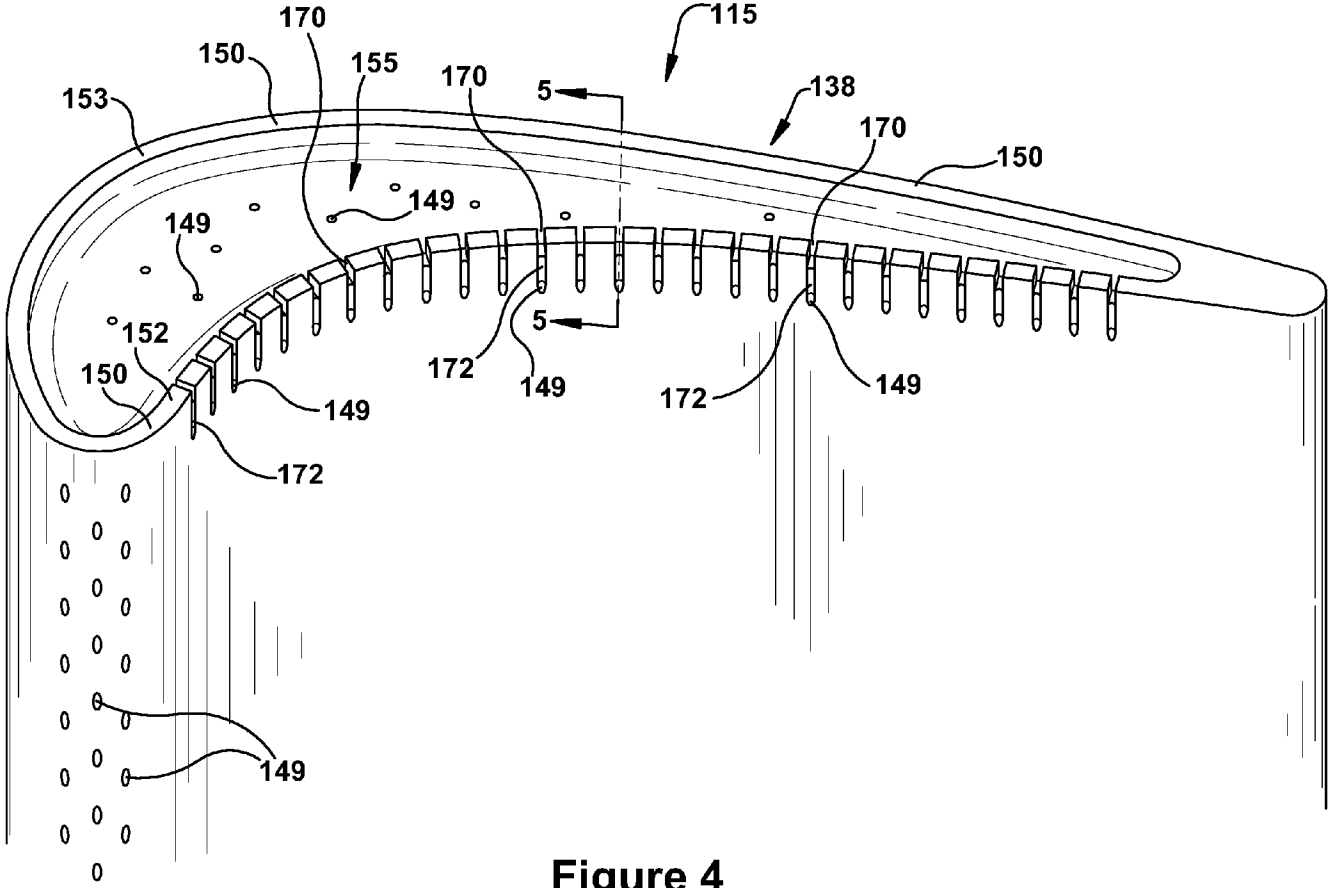
FIG. 4 is a perspective view of a turbine rotor blade having a squealer tip and incorporating a cooling arrangement in accordance with the present invention.
Figure 5:
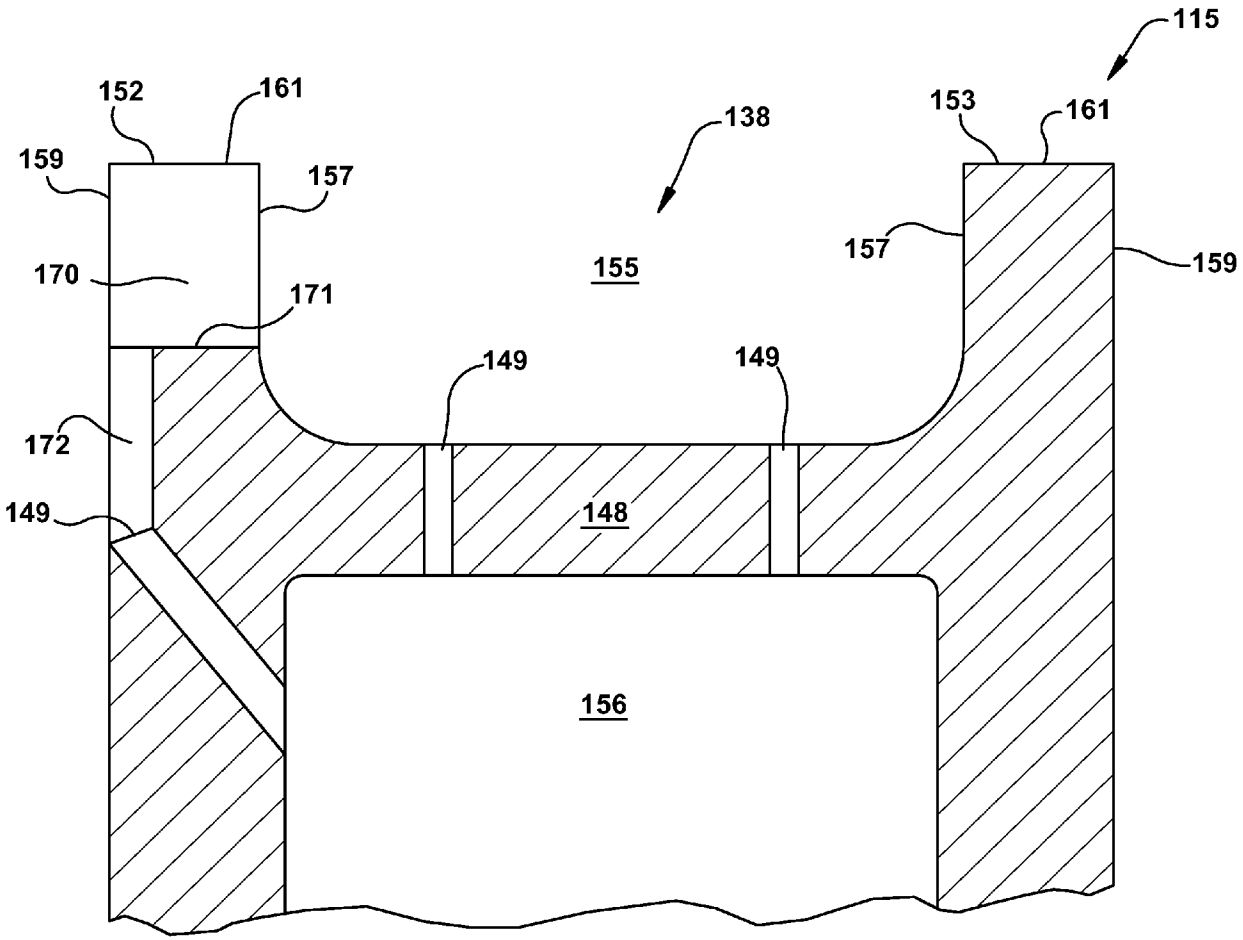
FIG. 5 is a cross-sectional view along 5-5 of the squealer tip of FIG. 4.
Figure 6:
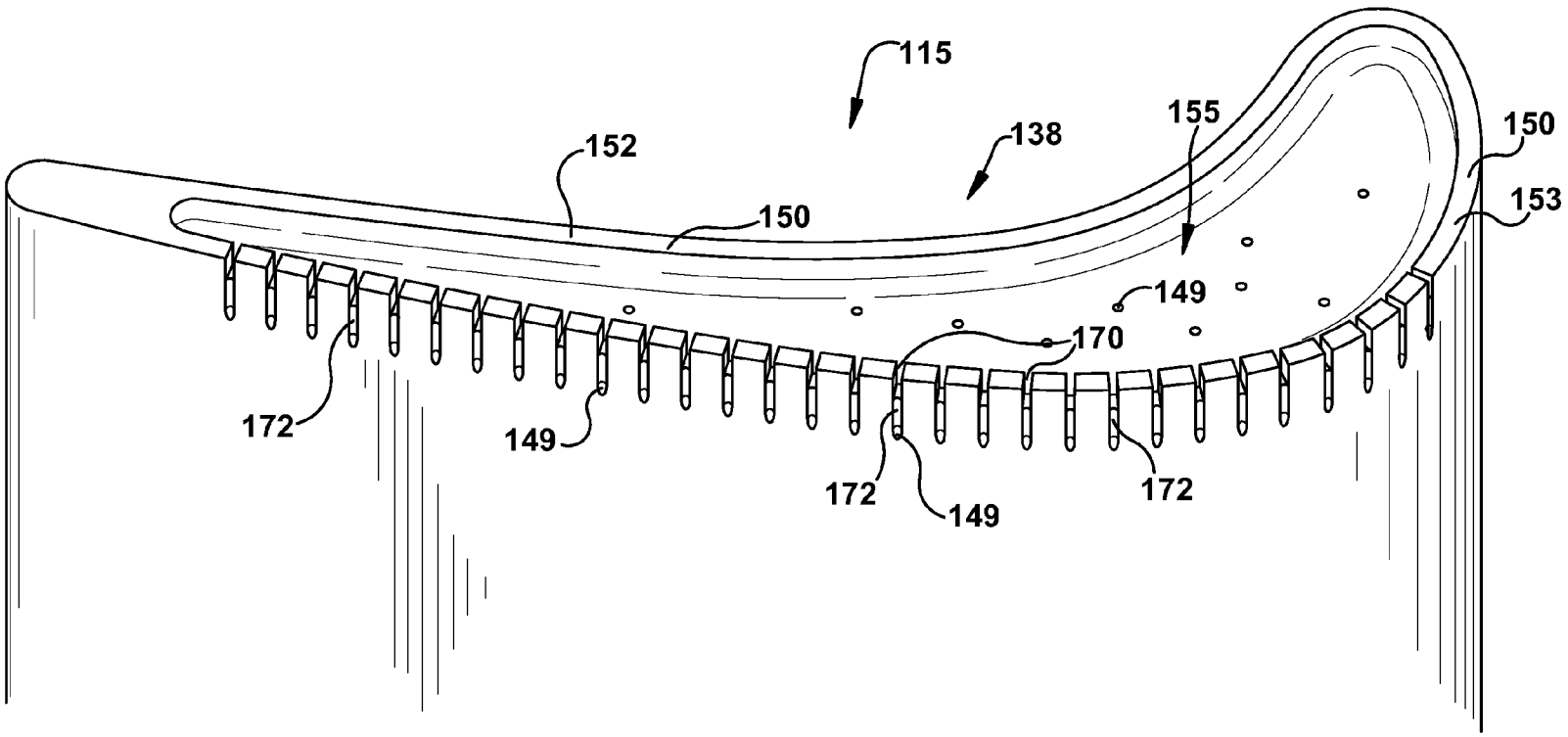
FIG. 6 is a perspective view of a turbine rotor blade having a squealer tip and incorporating an alternative cooling arrangement in accordance with the present invention.

Turning now to FIGS. 4 and 5, views of turbine rotor blade having a squealer tip that incorporates cooling arrangements consistent with the present invention are provided. As shown, the cooling arrangements may include a slotted region in the rail 150. The slotted region includes at least one slot 170, though typically the slotted region includes a plurality of slots 170. Each of the slots 170 are formed through the rail 150 of the squealer tip. In general, the slots 170 are passageways that extend through the thickness of the rail 150. That is, the slots 170 include an opening formed in the outer rail surface 157 that stretches across the rail 150 to an opening formed in the inner rail surface 159. As illustrated, in a preferred embodiment, the slots 170 may remain open through the outboard rail surface 161 of rail 150. That is, the slots 170 may extend from an inboard edge 171 to an opening formed in the outboard rail surface 161. As shown in FIG. 4, in a preferred embodiment, the slots 170 may be formed on the pressure side rail 152 of the squealer tip. However, as shown in FIG. 6, slots 170 may also be formed on the suction side rail 153 as well.

It will be appreciated that, within the airfoil 124, the pressure 128 and suction sidewalls 130 may be spaced apart in the circumferential and axial direction over most or the entire radial span of airfoil 124 to define at least one interior cooling passage 156 through the airfoil 124. As shown in FIG. 5, the interior cooling passage 156 generally channels coolant from a connection at the root of the rotor blade through the airfoil 124 so that the airfoil 124 does not overheat during operation via its exposure to the hot gas path. The coolant is typically compressed air bled from the compressor 102, which may be accomplished in a number of conventional ways. The interior cooling passage 156 may have any of a number of configurations, including, for example, serpentine flow channels with various turbulators therein for enhancing cooling air effectiveness, with cooling air being discharged through various outlets positioned along the airfoil 124, such as the film cooling outlets 149 that are shown on the tip cap 148 and airfoil surface.

Figure 7:
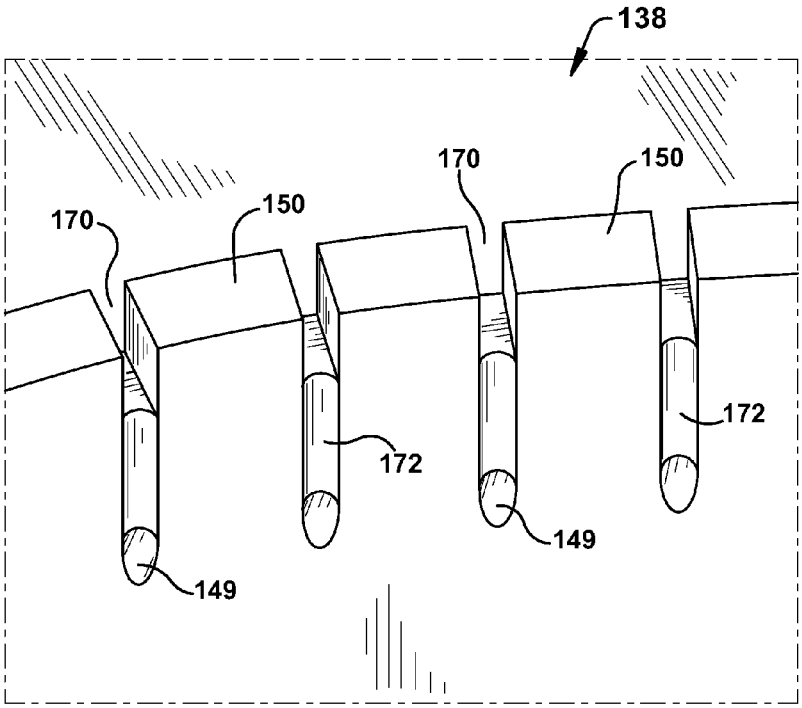
FIG. 7 is a perspective view of squealer tip rail that incorporates an alternative cooling arrangement in accordance with the present invention.

In a preferred embodiments, as shown in greater detail in FIG. 7, each slot 170 may have a groove 172 formed nearby which is configured to guide cooling air released from one or more nearby film cooling outlets into the slot 170. The groove 172, as shown, may be an elongated depression that extends along the surface of the airfoil 124, the outer rail surface 159, or a combination thereof depending on the particular configuration of the tip 138. As described, film cooling outlets 149 may be positioned in this region of the airfoil 124, i.e., just inboard of the slots 170. Each of the grooves 172 may be configured to extend in an outboard radial direction from a position at or just outboard of a film cooling outlet 149 to a position at or just inboard of an inboard edge 171 of the slot 170. In preferred embodiments, as shown most clearly in FIG. 7, the groove 172 may be positioned so that it connects the film cooling outlet 149 directly to the slot 170. In such cases, the groove 172 may channel coolant toward the slot 170. That is, the groove 172 may be configured such that it stretches between a connection made with both the film cooling outlet 149 and the slot 170. In this manner, the groove 172 may direct coolant exiting the outlet 149 toward the slot 170 so that more of the released coolant reaches the slot 170. Once the slot 170 is reached, the coolant may flow through the slot 170 and into the tip cavity 155. It will be appreciated that, in this manner, coolant may be directed with greater precision from film cooling outlets 149 to the tip cavity 155, thereby improving the cooling of the tip region of the blade 115.

Though preferred embodiments will be discussed herein and may be preferable according to certain criteria, those of ordinary skill in the art will appreciate that the particular configuration of a squealer tip having slots 170, grooves 172, and/or other of the above-described features may vary depending on operating conditions. Accordingly, while several of the preferred embodiments are discussed in conjunction with the several perspective views of slotted rails provided FIGS. 8 through 12, those of ordinary skill in the art will appreciate that all possible combinations of the elements of the present invention are not shown or discussed in detail, as such would be too exhaustive for current purposes. It should be understood that elements and other features which are not mutually exclusive may be combined, as defined by the scope of the appended claims, even if not specifically discussed herein.

Figure 8:
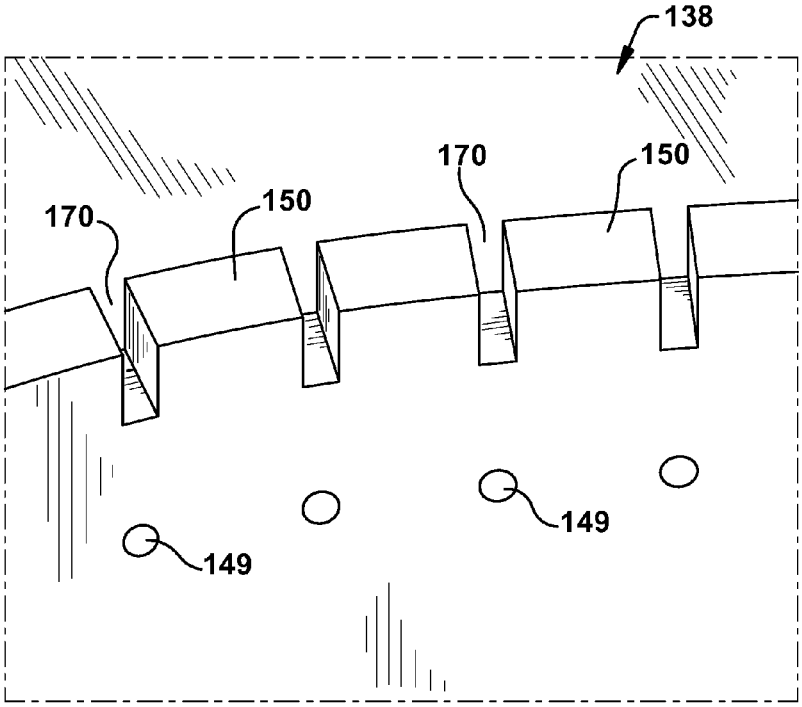
FIG. 8 is a perspective view of squealer tip rail that incorporates an alternative cooling arrangement in accordance with the present invention.
Figure 9:
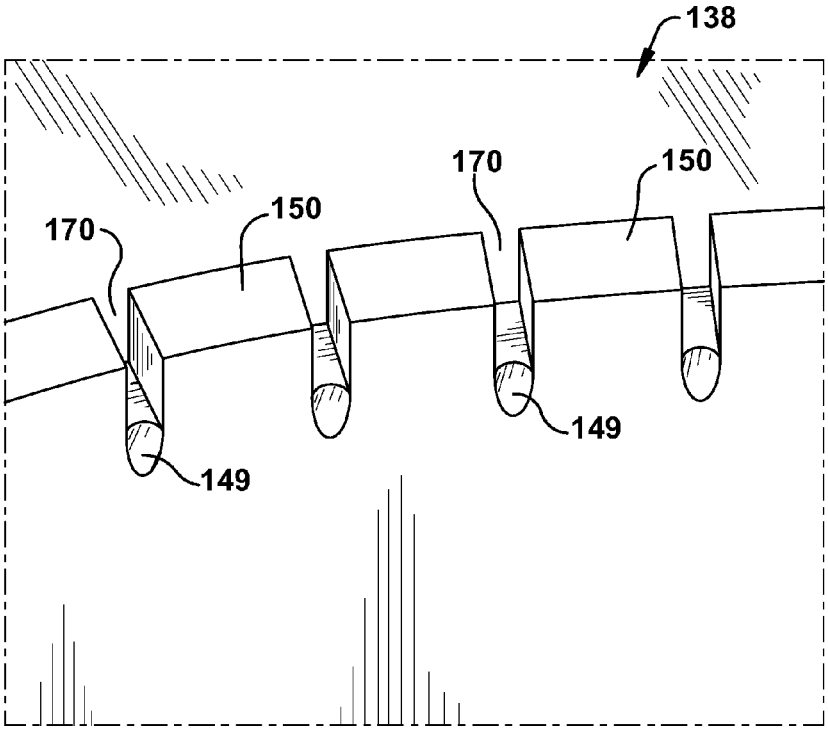
FIG. 9 is a perspective view of squealer tip rail that incorporates an alternative cooling arrangement in accordance with the present invention.

In certain embodiments, such as those illustrated in FIGS. 8 and 9, the slot 170 may function without the groove 172. In such cases, the film cooling outlet 149 may be located just inboard of the slot 170, as shown in FIG. 8, or may be incorporated into the inboard edge 171 of the slot 170, as shown in FIG. 9. Though the inclusion of grooves 172 may be preferable in certain circumstances, the flow patterns created by the slots 170 may be adequate for inducing an increased amount of coolant toward the tip region of the rotor blade.

Figure 10:
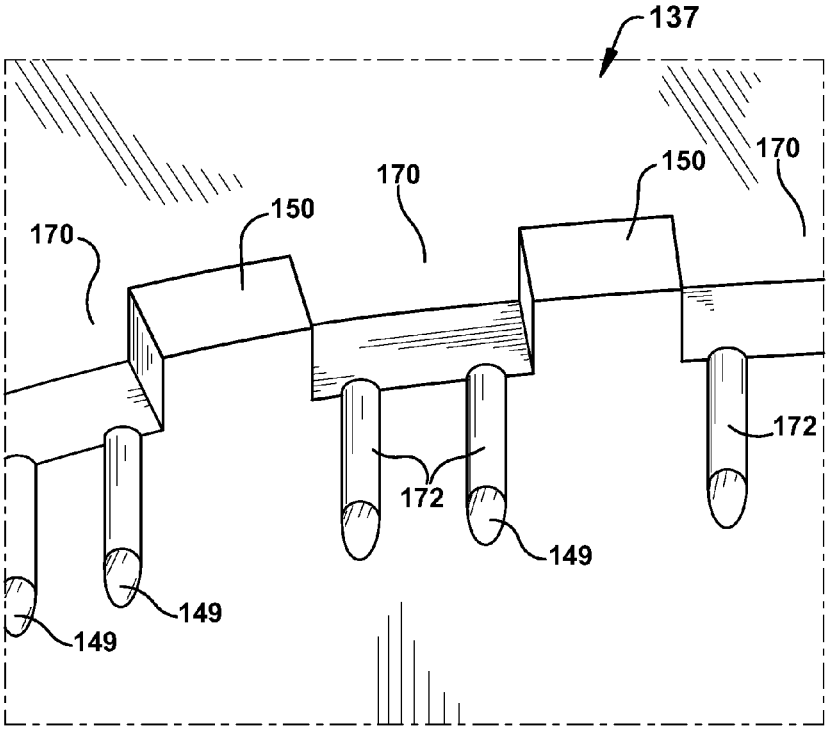
FIG. 10 is a perspective view of squealer tip rail that incorporates an alternative cooling arrangement in accordance with the present invention.

As shown in FIG. 10, in certain embodiments, the ratio of grooves 172 to slots 170 need not be a 1 to 1 ratio. In certain circumstances, for example, two grooves 170 may be provided for a single slot 170. Other ratios may also be used.

Figure 11:
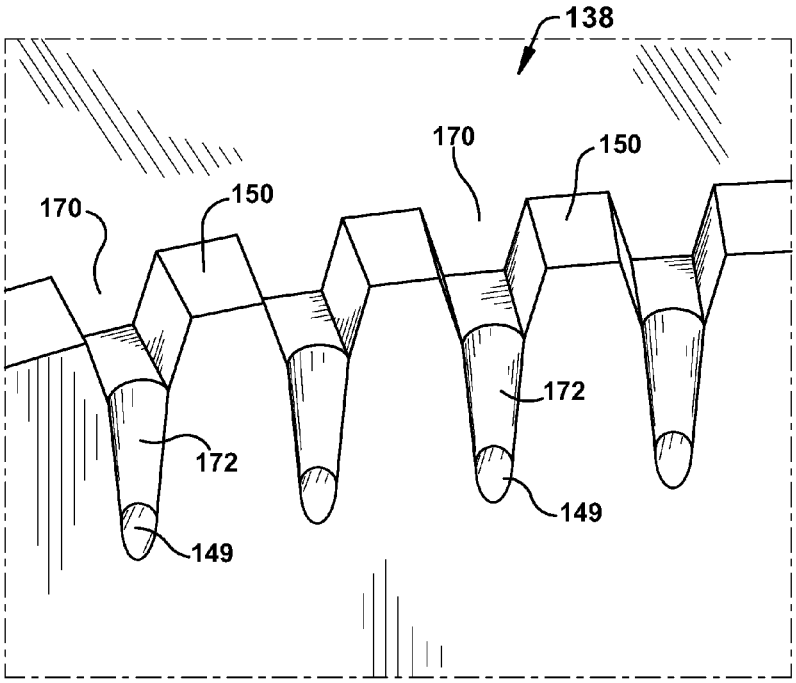
FIG. 11 is a perspective view of squealer tip rail that incorporates an alternative cooling arrangement in accordance with the present invention.

The slots 170 and the grooves 172 may be rectangular in shape. Specifically, the width of the groove 172 may be constant from an upstream end, which is near or adjacent to the film cooling outlet 149, to a downstream end, which is near or adjacent to the slot 170. As shown in FIG. 11, in an alternative embodiment, the groove 172 may widen as it extends toward the slot 170. Similarly, the slot 170 may widen as it extends radially toward the outboard rail surface 161 of the squealer tip. This type of configuration may allow the slots 170 and/or grooves 172 to capture and direct an increase amount of the coolant flow during operation. The grooves 172 may be optimized in shape pursuant to performance and manufacturing criteria. For example, the floor of the groove 172 may be curved, as shown, or flat.

Figure 12:
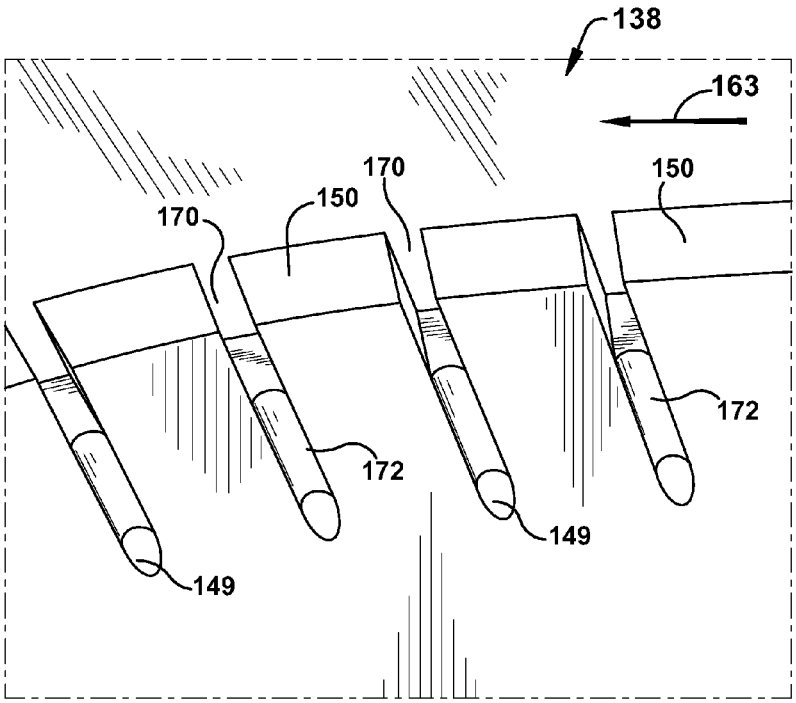
FIG. 12 is a perspective view of squealer tip rail that incorporates an alternative cooling arrangement in accordance with the present invention.

FIG. 12 is a close-up perspective view of squealer tip rail that incorporates an alternative cooling arrangement in accordance with the present invention. As shown, in certain embodiments, the slot 170 and the groove 172 may be canted in relation to the radial direction. The slot 170 and the groove 172 may be canted in the upstream direction, or, in a preferred embodiment, the slot 170 and the groove 172 may be canted in the downstream direction. Given the flow paths of working fluid through this region, angling the slot 170 and the groove 172 in the downstream direction may allow for the slots 170 and/or grooves 172 to more effectively influence the flow direction of the released coolant and/or direct greater amounts of coolant into the tip cavity 155 as the coolant is driven rearward by the working fluid. Alternatively, the slot 170 and groove 172 pair may maintain differing angles of orientation or, in certain cases, be curved.

In addition, the film cooling outlets 149, as described, may be configured so that a small angle is formed between the direction of release and surface of the airfoil. It will be appreciated that this limits the ability of the hot gas working fluid to get under the film layer or film jets formed by the released coolant. It is a well-established fact that tangential film cooling on a surface is more efficient than film cooling issued at an angle. In preferred embodiments, the film cooling outlets 149 are configured to directionally release coolant consistent with the direction of the grooves 172 and/or slots 170 into which the coolant is released.

The radial depth of the slot 170 may vary. The radial height of the rail 170 may be described as the distance from the radial position of the tip cap 148 to the radial position of the outboard rail surface 161. Similarly, the radial height of the slots 170 may be described as the distance from the radial position of the inboard edge 171 of the slot 170 to the radial position of the outboard rail surface 161, as illustrated in FIG. 5. In a preferred embodiment, the radial height of each of the slots 170 may be at least half (0.5) of the radial height of the rail 150.

The slots 170 and grooves 172 may be of various configurations, depths and/or shapes. It will be appreciated that the slots 170 and grooves 172 serve to contain the film cooling and shelter it from mixing with the hot gases, while guiding it along a preferred path such that the cooling needs of the region are more efficiently satisfied. The slots 170 and grooves 172 also serve to increase the external surface area covered by the film cooling. The slots 170 and grooves 172 may be cast features in the blade tip, or machined after casting, or even simply formed by laser, water jet, or EDM drilling as part of the process of forming the film outlets 149 themselves. As stated, the slots 170 and grooves 172 need not be of constant cross section, but could also flare in or out in size with distance from the film cooling outlet 149, which can provide added benefit in performance. The depth of the groove 172 into the surface can vary; this is not restricted by the dimension of the film cooling outlet 149. In certain embodiments, two or more grooves 172 may proceed from a single film cooling outlet 149 to help spread the cooling while also protecting the coolant from mixing with hot gases.

Figure 13:
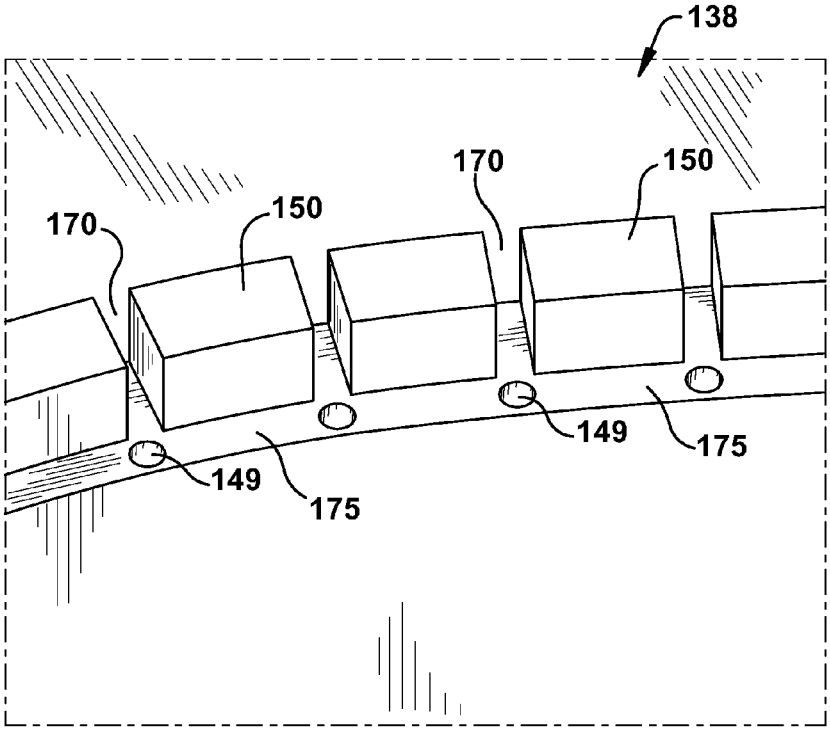
FIG. 13 is a perspective view of squealer tip rail that incorporates an alternative cooling arrangement in accordance with the present invention.

As shown in FIG. 13, a shelf 175 may be formed on the pressure or suction side wall near the inboard edge of the slots 170. In such cases, the film cooling outlets 149 may be positioned on the shelf 175. It will be appreciated that this configuration may allow for the release of cooling in the radial direction, which may result in more coolant ingestion into each slot 170.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

We claim:

1. A rotor blade for a turbine of a combustion turbine engine, the rotor blade comprising an airfoil that includes a pressure sidewall and a suction sidewall defining an outer periphery and a tip portion defining an outer radial end, the tip portion including a rail that defines a tip cavity, wherein the airfoil includes an interior cooling passage configured to circulate coolant through the airfoil during operation, the rotor blade comprising:

a slotted portion of the rail; and at least one film cooling outlet disposed within at least one of the pressure sidewall and the suction sidewall of the airfoil, the film cooling outlet comprising a position that is adjacent to the tip portion and in proximity to the slotted portion of the rail;

wherein:

the interior cooling passage extends from a connection with a coolant source at a root of the rotor blade and the film cooling outlet comprises a port disposed in flow communication with the interior cooling passage;

a tip cap forms a floor of the tip cavity and the rail extends radially from the tip cap;

the film cooling outlet is positioned inboard of and near the slot;

wherein:

the pressure sidewall and suction sidewall join together at a leading airfoil edge and a trailing airfoil edge, the pressure sidewall and the suction sidewall extending from the root to the squealer tip and defining the interior cooling passage therein;

the rail includes a pressure side rail and a suction side rail, the pressure side rail connecting to the suction side rail at a leading rail edge and a trailing rail edge;

the pressure side rail extends from the leading rail edge to the trailing rail edge such that the pressure side rail approximately aligns with a profile of an outer radial edge of the pressure sidewall;

the suction side rail extends from the leading rail edge to the trailing rail edge such that the suction side rail approximately aligns with a profile of an outer radial edge of the suction sidewall;

wherein:

the rail includes an inner rail surface, which faces inwardly and defines the tip cavity, an outer rail surface, which faces outwardly;

the rail includes an outboard rail surface, which faces in an outboard direction;

wherein:

the slot comprises a passageway cut through the thickness of the rail;

the passageway of the slot extends from an opening formed on the outer rail surface to an opening formed on the inner rail surface;

the passageway of the slot extends radially from an inboard edge of the slot to an opening formed through the outboard rail surface;

wherein the slotted portion of the rail comprises a plurality of regularly spaced slots; and wherein the plurality of slots are disposed in parallel on the pressure side rail.

2. The rotor blade according to claim 1, further comprising a groove extending from a position adjacent to the film cooling outlet toward the slotted portion of the rail;

wherein the tip portion comprises a squealer tip.

3. The rotor blade according to claim 1, further comprising a shelf formed just inboard of the slot on one of the pressure sidewall and the suction sidewall;

wherein the film cooling outlet is positioned on the shelf and oriented such that coolant released therefrom comprises an approximate radial direction.

4. The rotor blade according to claim 1, further comprising a groove extending from the film cooling outlet to the slot.

5. The rotor blade according to claim 1, wherein the tip cap is configured to extend axially and circumferentially to connect the outer radial edge of the suction sidewall to the outer radial edge of the pressure sidewall; and wherein the rail is disposed at a periphery of the tip cap.

6. The rotor blade according to claim 1, wherein the plurality of slots are disposed in parallel on the suction side.

7. The rotor blade according to claim 1, wherein the at least one film cooling outlet comprises a plurality of film cooling outlets; and wherein for each of the plurality of slots there is at least one corresponding film cooling outlet, each of the corresponding film cooling outlets comprising a position inboard and in proximity to the slot to which the film cooling outlets corresponds.

8. The rotor blade according to claim 7, further comprising a plurality of grooves;

wherein each pair of corresponding film cooling outlets and slots includes a groove stretching therebetween, the groove being configured to direct a flow of coolant expelled from the film cooling outlet to the slot.

9. The rotor blade according to claim 8, wherein each of the plurality of grooves comprises an elongated depression that extends along an outer surface of the rotor blade; and wherein each of the plurality of the grooves connects the film cooling outlet to the inboard edge of the slot.

10. The rotor blade according to claim 1, wherein the at least one film cooling outlet comprises a plurality of film cooling outlets; and wherein for each of the plurality of slots there is at least one corresponding film cooling outlet, each of the corresponding film cooling outlets being integrated into the inboard edge of the slot to which the film cooling outlets corresponds.

11. The rotor blade according to claim 1, wherein the at least one film cooling outlet comprises a plurality of film cooling outlets; and wherein for each of the plurality of slots there is at least two corresponding film cooling outlets, each of the two corresponding film cooling outlets comprising a position inboard and in proximity to the slot to which each of the two film cooling outlets corresponds.

12. The rotor blade according to claim 1, wherein a radial height of the rail comprises a distance from the radial position of the tip cap to the radial position of the outboard face of the rail;

wherein a radial height of the slots comprises a distance from the radial position of the inboard edge of the slot to the radial position of the outboard face of the rail; and wherein the radial height of each of the plurality of slots is at least 0.5 of the radial height of the rail.

13. A rotor blade for a turbine of a combustion turbine engine, the rotor blade comprising an airfoil that includes a pressure sidewall and a suction sidewall defining an outer periphery and a tip portion defining an outer radial end, the tip portion including a rail that defines a tip cavity, wherein the airfoil includes an interior cooling passage configured to circulate coolant through the airfoil during operation, the rotor blade comprising:

a slotted portion of the rail, the slotted portion of the rail including a plurality of slots spaced thereon; and a plurality of film cooling outlets disposed within at least one of the pressure sidewall and the suction sidewall of the airfoil, each of the plurality of film cooling outlets comprising a position that is adjacent to the tip portion and in proximity to the slotted portion of the rail, and each of the plurality of film cooling outlets fluidly communicating with the interior cooling passage;

a plurality of grooves formed between the slotted portion of the rail and the plurality of film cooling outlets;

wherein the plurality of slots and the plurality of film cooling outlets and the plurality of grooves are configured such that each of the plurality of grooves extends in an approximate radially outward direction from a position at or just outboard of one of the plurality of film cooling outlets to a position at or just inboard of an inboard edge of one of the plurality of slots; and wherein each of the plurality of grooves and each of the plurality of slots are canted with respect to a radially aligned reference line.

14. The rotor blade according to claim 13, wherein each of the plurality of film cooling outlets is incorporated into an inboard edge of the groove; and wherein the groove connects to the inboard edge of one of the plurality of slots.

15. The rotor blade according to claim 13, wherein each of the plurality of grooves and each of the plurality of slots comprise a rectangular profile having a substantially constant width.

16. The rotor blade according to claim 13, wherein each of the plurality of grooves comprises a variable width as the groove extends; and wherein each of the plurality of slots comprises a variable width as the slot extends.

17. The rotor blade according to claim 13, wherein the plurality of grooves and the plurality of slots are canted toward the downstream direction, the downstream direction being relative to a flow direction of working fluid through the turbine; and wherein each of the film cooling outlets is configured to release coolant in a direction that approximately corresponds with the cant of the plurality of grooves and the plurality of slots.

18. A rotor blade for a turbine of a combustion turbine engine, the rotor blade comprising an airfoil that includes a pressure sidewall and a suction sidewall defining an outer periphery and a tip portion defining an outer radial end, the tip portion including a rail that defines a tip cavity, wherein the airfoil includes an interior cooling passage configured to circulate coolant through the airfoil during operation, the rotor blade comprising:

a slotted portion of the rail, the slotted portion of the rail including a plurality of slots spaced thereon; and a plurality of film cooling outlets disposed within at least one of the pressure sidewall and the suction sidewall of the airfoil, each of the plurality of film cooling outlets comprising a position that is adjacent to the tip portion and in proximity to the slotted portion of the rail, and each of the plurality of film cooling outlets fluidly communicating with the interior cooling passage;

a plurality of grooves formed between the slotted portion of the rail and the plurality of film cooling outlets;

wherein the plurality of slots and the plurality of film cooling outlets and the plurality of grooves are configured such that each of the plurality of grooves extends in an approximate radially outward direction from a position at or just outboard of one of the plurality of film cooling outlets to a position at or just inboard of an inboard edge of one of the plurality of slots;

wherein each of the plurality of grooves comprises a variable width as the groove extends in the radial direction; and wherein each of the plurality of slots comprises a variable width as the slot extends in the radial direction.

* * * * *